US005222553A

United States Patent [19]

Temple

[11] Patent Number: 5,222,553

[45] Date of Patent: Jun. 29, 1993

[54] WATER WELL PUMP

[76] Inventor: Alvin Temple, Apt. F, 1802 - 11 Avenue SW., Calgary, Alberta, Canada, T3C 0N6

[21] Appl. No.: 875,418

[22] Filed: Apr. 29, 1992

[51] Int. Cl.[5] ..... E03B 3/08; E21B 43/00

[52] U.S. Cl. ..... 166/75.1; 166/105; 417/544

[58] Field of Search ..... 166/75.1, 81, 84, 105, 166/106; 417/544

[56] References Cited

U.S. PATENT DOCUMENTS

| | | | |
|---|---|---|---|
| 597,576 | 1/1898 | Gaskins | 417/544 |
| 2,364,511 | 12/1944 | Bossi | 417/544 |
| 3,186,722 | 6/1965 | Johnston | 166/84 |
| 4,262,742 | 4/1981 | James | 166/84 X |

*Primary Examiner*—Terry Lee Melius
*Attorney, Agent, or Firm*—George H. Dunsmuir

[57] ABSTRACT

A manually operable water well pump includes a baseplate with a casing thereon, a rocker arm pivotally mounted in the casing for reciprocating movement therein, a chain on one end of the rocker arm outside the casing for reciprocating vertical movement with the rocker arm, a connector on the free end of the chain for connecting the latter to a pump rod, whereby the rod can be reciprocated in a well casing, the transmission in the casing including a pair of gears interconnected by an endless chain, a crank for rotating the smaller of the gears and a linkage between the larger of the gears and the other end of the rocker arm for reciprocating the latter, and a tank suspended from the baseplate concentric with the pump rod for mounting on a well casing to receive and discharge water from the well.

9 Claims, 4 Drawing Sheets

WATER WELL PUMP

BACKGROUND OF THE INVENTION

This invention relates to a pump, and in particular to a manually operable pump for a water well. The conventional pump for a water well is a simple device, which is operated by a long handle or lever. Over the years there has been precious little change in the structure of such pumps, which can be somewhat mechanically inefficient. The present inventor has found that this problem can be solved by using some of the same principles used in pump jacks for oil wells.

The object of the present invention is to provide a relatively simple pump for a water well, which is mechanically efficient and easy to operate.

BRIEF SUMMARY OF THE INVENTION

Accordingly, the present invention relates to a pump comprising baseplate means; casing means on said baseplate means; rocker arm means mounted in said casing means for reciprocating rotary movement therein; drive means in said casing means for rotating said rocker arm means; chain means on an outer end of said rocker arm means for reciprocating vertical movement with said rocker arm means; coupler means on said chain means for connecting the latter to a pump rod, whereby the rod can be reciprocated in a well casing; and tank means suspended from said baseplate concentric with said pump rod for mounting on a well casing to receive water from the well.

BRIEF DESCRIPTION OF THE DRAWINGS

The invention will be described in greater detail with reference to the accompanying drawings, which illustrate a preferred embodiment of the invention, and wherein.

DESCRIPTION OF THE PREFERRED EMBODIMENT(S)

Figure 2:
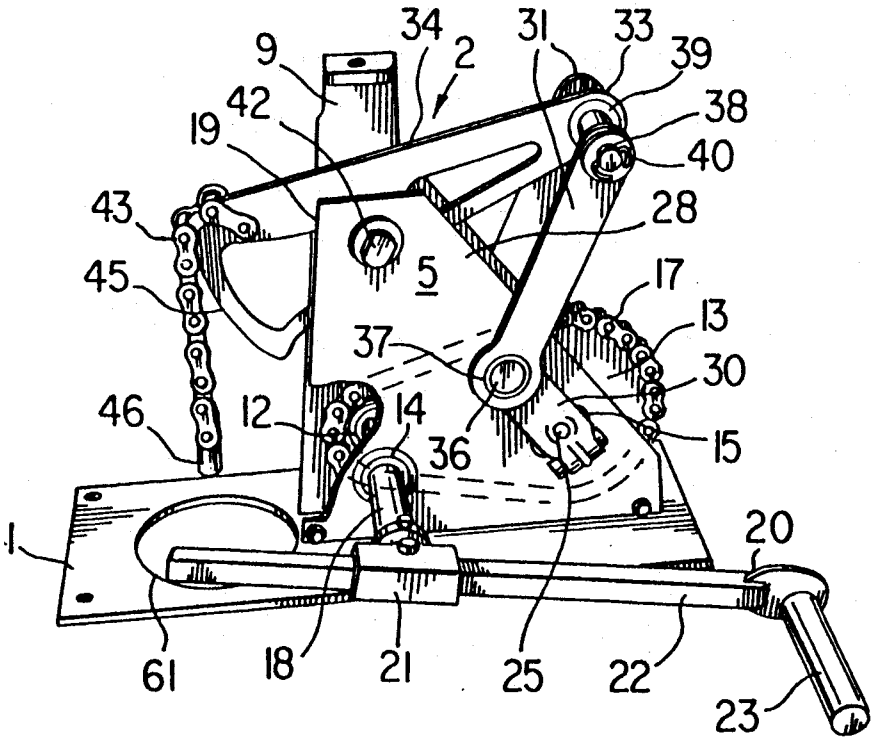
FIG. 2 is a partly sectioned, isometric view of the pump of FIG. 1 from one side and slightly above with parts omitted.

Wherever possible the same reference numerals have been used in the various figures of the drawings to identify the same or similar elements.

Figure 1:
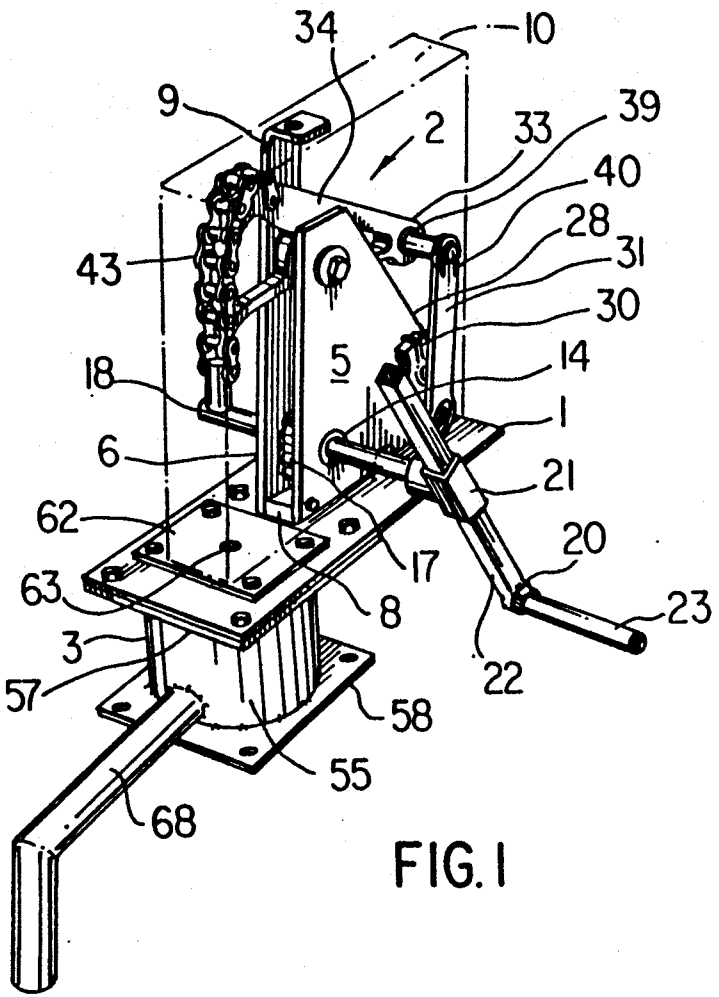
FIG. 1 is a schematic, isometric view from above and one end of a pump in accordance with the present invention.
Figure 3:
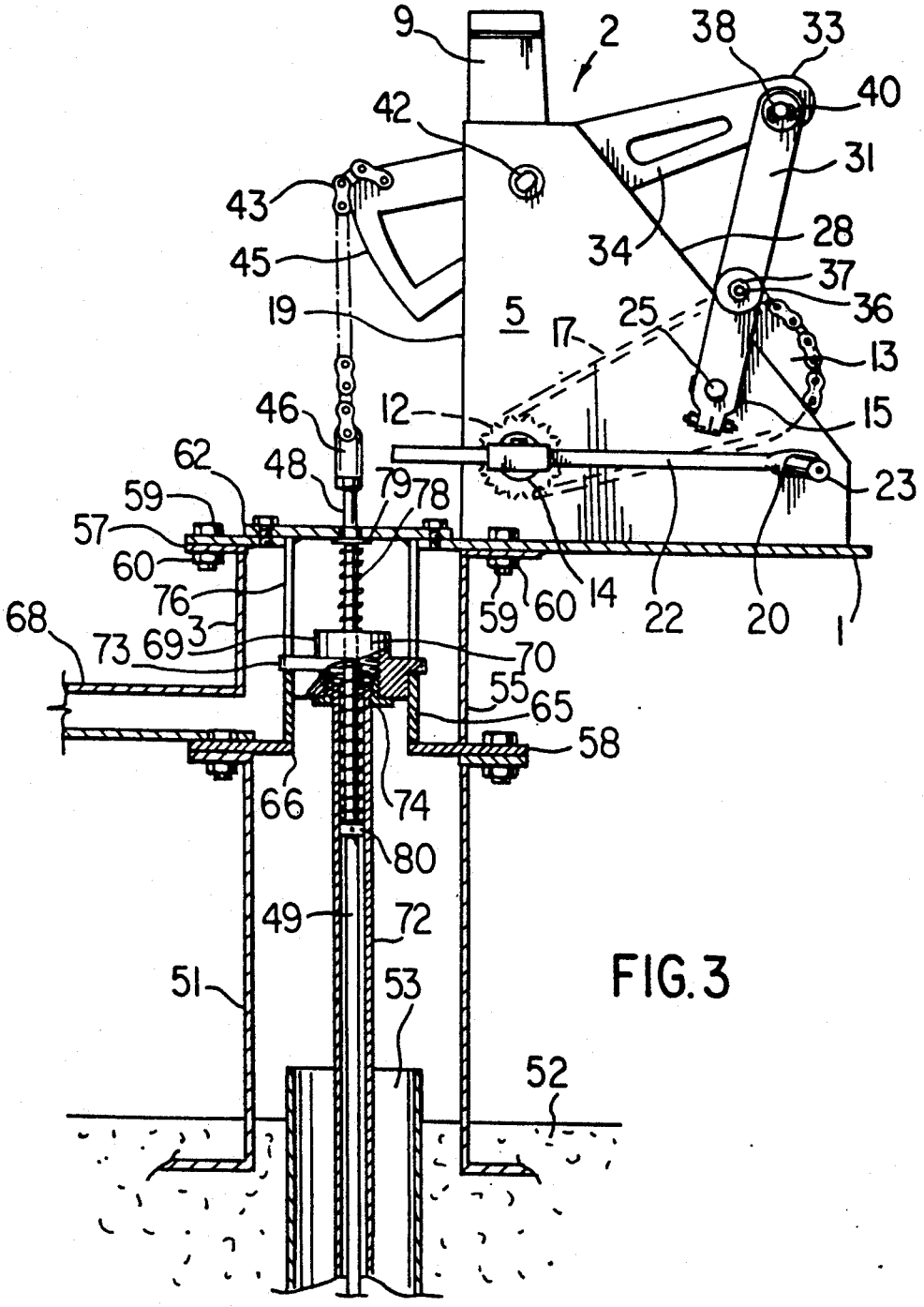
FIG. 3 is a partly sectioned side view of the pump of FIGS. 1 and 2 in the use position.

With reference to FIGS. 1 to 3; the pump of the present invention includes a baseplate 1, which carries a casing generally indicated at 2 and a cylindrical tank 3. The casing 2 is defined by a pair of generally triangular sides 5 and 6 interconnected at their bottom ends by a strip 8. An inverted L-shaped post 9 integral with one of the sides 6 extends upwardly for supporting a cover 10 (FIG. 1). The cover 10 is intended to protect the user.

A pair of toothed sprockets 12 and 13 are mounted in bearings 14 and 15, respectively in each of the sides 5 and 6 of the frame 2. A chain 17 extends around the sprockets 12 and 13. A shaft 18 carrying the smaller sprocket 12 extends through the bearings 14 beyond the frame sides 5 and 6 at one end 19 of the frame 2. The shaft 18 is rotated by an elongated L-shaped crank 20, which is connected to the shaft 18 by a T-shaped, tubular coupler 21. The outer end of the coupler 21 and the longer arm 22 of the crank 20 have a square cross section, and the short arm 23 of the crank is cylindrical for use as a handle by the pump operator. Rotation of the shaft 18 is accompanied by rotation of the transmission defined by the sprockets 12 and 13, and the chain 17. A short shaft 25 carrying the larger sprocket 13 extends through the bearings 15 in the sides 5 and 6 at the other end 28 of the frame 2.

Articulated crank arms 30 and 31 connect each outer end of the shaft 25 to one end 33 of a rocker arm 34. The arms 30 and 31 are pivotally interconnected by a pin 36 and a roller bearing 37. The upper end of each top arm 31 is pivotally connected to one end of a shaft 38, which extends through a bearing 39 in the end 33 of the rocker arm 34. The arms 31 are retained on the shaft 38 by a cotter pin 40.

The generally triangular rocker arm 34 is pivotally mounted on a shaft 42 extending between the sides 5 and 6 of the frame 2 near the end 19. One end of a chain 43 is connected to the top of the arcuate outer free end 45 of the rocker arm 34. The chain 43 straddles the end 45 of the rocker arm 34, so that the rocker arm engages the chain during reciprocating rotation of the arm around the axis of the shaft 42. An internally threaded coupler 46 is provided on the bottom end of the chain 43 for connecting the latter to the threaded upper end 48 (FIGS. 3 and 5) of a pump rod 49. The pump rod 49 extends downwardly through the tank 3 and a standpipe 51, which is embedded in a concrete pad 52 at the top of a well casing 53.

Figure 4:
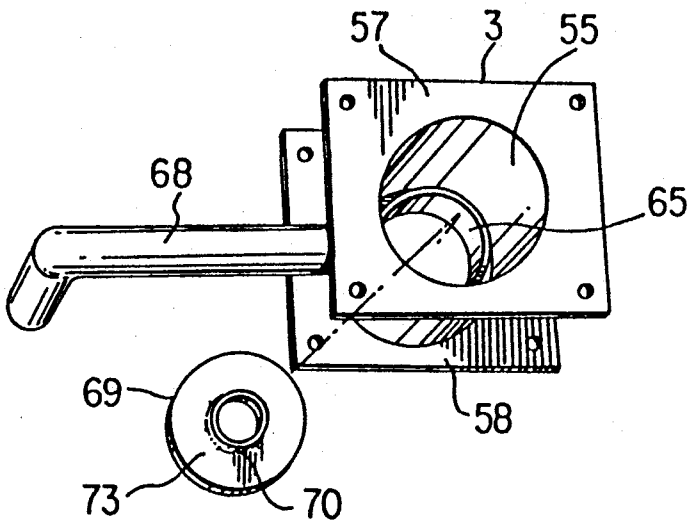
FIG. 4 is an exploded, isometric view of a tank and pipe retainer used in the pump of FIGS. 1 to 3.

As best shown in FIG. 4, the tank 3 includes a cylindrical side wall 55, and rectangular top and bottom plates 57 and 58, respectively. The top plate 57 is connected to the baseplate 1 by bolts 59 and nuts 60 (FIGS. 1 and 3) beneath an opening 61 (FIG. 2) in the baseplate 1. The opening is closed by a square cover 62 with a hole 63 in the center thereof for slidably receiving the rod 49. An inlet pipe 65 extends upwardly from the bottom plate 58 around a central opening 66 therein. An L-shaped outlet spout 68 extends outwardly from the side wall 55 near the bottom end thereof.

The top of the pipe 65 is closed by a riser pipe retainer 69, which includes a central, internally threaded sleeve 70 for mounting on the top end of a well riser pipe 72. An annular flange 73 extends outwardly from the sleeve 70 for seating on the pipe 65. In the form shown in FIG. 3, an externally threaded coupler 74 is mounted on the top end of the pipe 72, and connected to the retainer 69. In the embodiment of the invention shown in FIG. 5, the sleeve 70 is connected directly to the top end of the pipe 72. In each case, a slotted, cylindrical sleeve 76 extends downwardly from the plate 72 and seats on the retainer 69.

Figure 5:
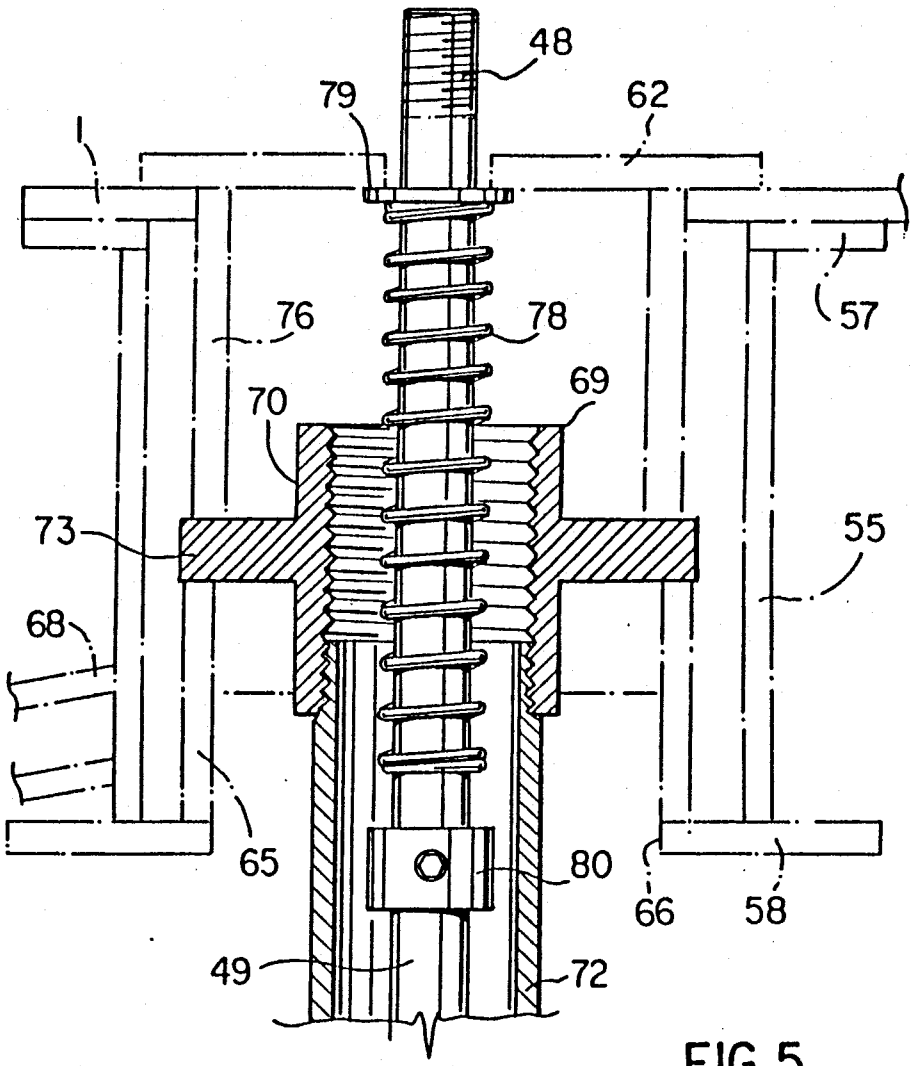
FIG. 5 is a longitudinal sectional view of a pump rod and spring assembly used in the apparatus of FIGS. 1 to 3.

A helical spring 78 is mounted on the rod 49 between a washer 79, which bears against the plate 62 and a collar 80 on the rod 49. The spring 78 biases the rod 49 downwardly, ensuring a smooth return stroke when the rod is released from the chain 43. The structure illustrated in FIGS. 3 and 5 is designed for shallow wells.

Figure 6:
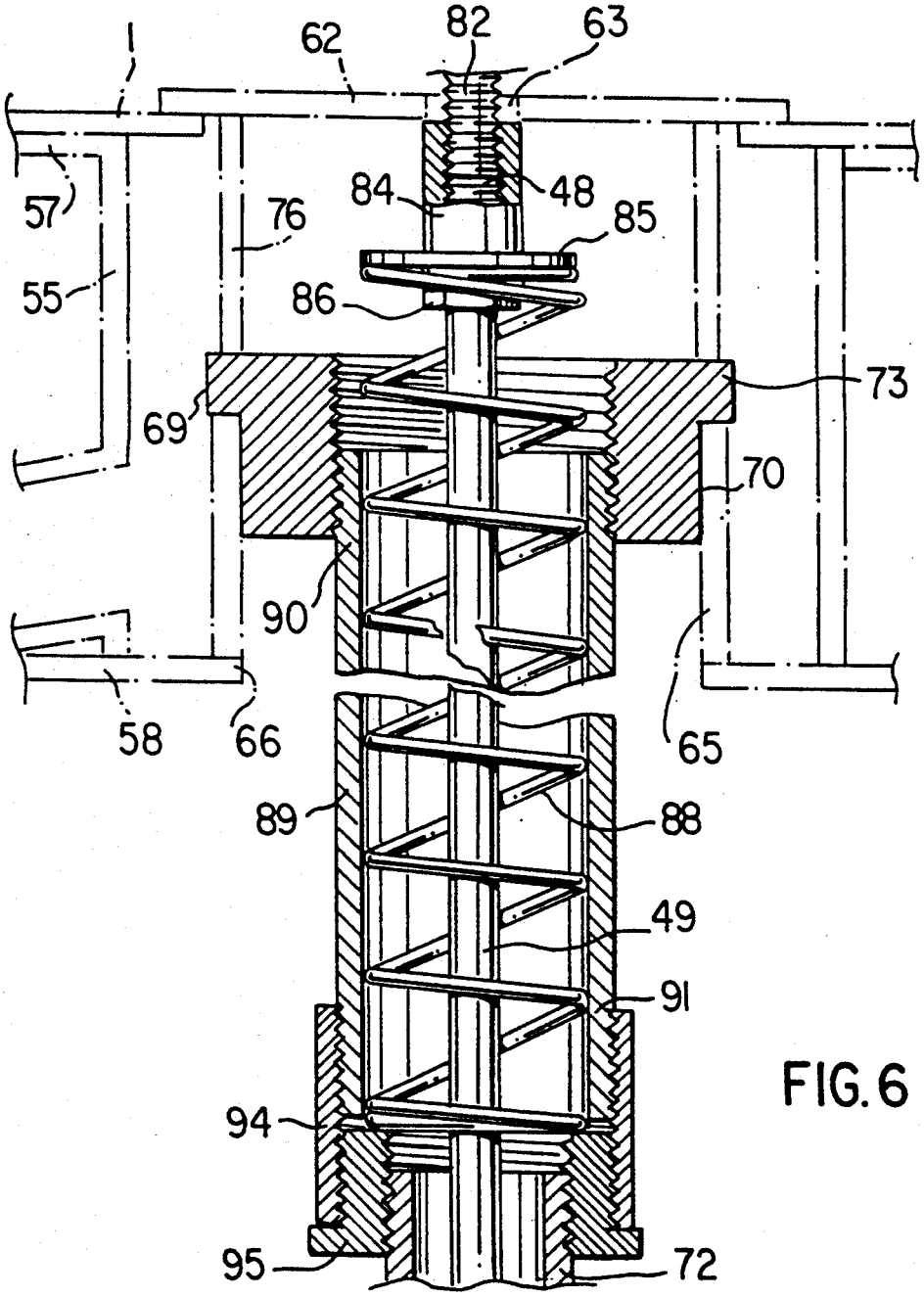
FIG. 6 is a longitudinal sectional view of an alternate form of pump rod and spring assembly for use in the apparatus of the present invention.

An assembly intended for deep well use is shown in FIG. 6. In the assembly of FIG. 6, a threaded rod 82 extends downwardly from the sleeve 46 on the bottom end of the chain 43 through the hole 63 in the plate 62. The rod 82 is connected to the upper end 48 of the rod 49 by an internally threaded coupler 84. A washer 85 is sandwiched between the coupler 84 and a nut 86. The washer 85 acts as a top stop for a heavy duty helical spring 88, which is coaxial with the rod 49. The spring 88 is housed in a tube 89 with externally threaded top and bottom ends 90 and 91, respectively for connecting the tube to the retainer 69 at the top end, and to a sleeve 94 and tubular coupler 95 at the bottom end thereof. The coupler 95 is mounted on the top end of the riser pipe 72, and acts as a seat for the bottom end of the spring 88.

In the operation, when the handle 23 is grasped to turn the crank 22, the gears 12 and 13, and the chain 17 are caused to rotate. Such motion is transmitted through the arms 30 and 31 to the rocker arm 34, which is caused to reciprocate around the axis of the shaft 42. Consequently, the chain 43 and the rod 49 are caused to reciprocate in the riser pipe 72. Water drawn up through the tube 72 enters the tank 3 and is discharged via the slotted sleeve 76 and the spout 68.

As will also be appreciated, while the two embodiments of the invention described above, are adapted for manual actuation, in each case the pump could be power driven by, for example an electric, gasoline, or hydraulic motor.

What is claimed is:

1. A pump comprising baseplate means; casing means on said baseplate means; rocker arm means mounted in said casing means for reciprocating rotary movement therein; drive means in said casing means for rotating said rocker arm means; chain means on an outer end of said rocker arm means for reciprocating vertical movement with said rocker arm means; coupler means on said chain means for connecting the latter to a pump rod, whereby the rod can be reciprocated in a well casing; and tank means suspended from said baseplate concentric with said pump rod for mounting on a well casing to receive water from the well.

2. A pump according to claim 1, wherein said drive means includes transmission means in said casing means connected to said rocker arm means; and crank means on said casing means for manually operating said transmission means.

3. A pump according to claim 2, wherein said transmission means includes first, small gear means for rotation by said crank means; second, larger gear means for reciprocating rotation of one end of said rocker arm means; and endless chain means extending around said first and second gear means.

4. A pump according to claim 3, wherein said crank means includes shaft means extending through said casing means and said first gear means; and handle means on one outer end of said shaft means for rotating the latter.

5. A pump according to claim 1, including tubular retainer means in said tank means for mounting on the top end of a well riser pipe; and helical spring means for mounting on the pump rod for biasing the latter downwardly into a well.

6. A pump according to claim 5, wherein said tank means includes a cylindrical side wall, an annular bottom wall, inlet tube means extending upwardly from the inner periphery of said bottom wall for supporting said retainer means; and outlet means in said side wall for discharging water from the tank means.

7. A pump according to claim 6, wherein said tank means includes cover means on said baseplate means for slidably receiving the pump rod; and slotted first sleeve means extending downwardly from said cover means into engagement with said retainer means, whereby water entering the tank means through said inlet tube means is discharged through said first sleeve means and said outlet means.

8. A pump according to claim 7, wherein said retainer means includes second, internally threaded sleeve means for connection to a well riser pipe around said pump rod; and annular flange means for seating on said inlet tube means and for supporting said first sleeve means.

9. A pump according to claim 8, including third sleeve means for mounting on the pump rod beneath said tank means, said third sleeve means retaining said spring means on the upper end of the pump rod.

* * * * *